US011013319B2

(12) United States Patent
Felsenthal et al.

(10) Patent No.: US 11,013,319 B2
(45) Date of Patent: May 25, 2021

(54) WARDROBE WITH STORAGE UNIT

(71) Applicant: Whitmor, Inc., Southaven, MS (US)

(72) Inventors: Sandy Felsenthal, Memphis, TN (US); Gil Gaska, Germantown, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 16/890,452

(22) Filed: Jun. 2, 2020

(65) Prior Publication Data

US 2020/0288863 A1 Sep. 17, 2020

Related U.S. Application Data

(63) Continuation-in-part of application No. 29/645,693, filed on Apr. 27, 2018, now Pat. No. Des. 887,188.

(51) Int. Cl.

| | |
|---|---|
| ***A47B 61/00*** | (2006.01) |
| ***A47B 96/14*** | (2006.01) |
| *A47G 25/06* | (2006.01) |
| *A47F 7/19* | (2006.01) |
| *A47F 7/24* | (2006.01) |

(52) U.S. Cl.

CPC ..... *A47B 61/003* (2013.01); *A47B 96/1441* (2013.01); *A47F 7/19* (2013.01); *A47F 7/24* (2013.01); *A47G 25/06* (2013.01)

(58) Field of Classification Search

CPC ... A47B 61/003; A47B 96/1441; A47B 61/02; A47F 7/18; A47F 7/19; A47F 7/24; A47G 25/06; A47G 25/0664; A47G 25/0685

USPC ..... 280/47.34, 47.35, 79.11, 79.3; 211/85.3; D34/17, 23

See application file for complete search history.

(56) References Cited

U.S. PATENT DOCUMENTS 2,016,520 A * 10/1935 Short ..... A45C 7/0077 206/289
2,058,217 A * 10/1936 Dixon ..... A47G 25/74 211/119
2,103,642 A * 12/1937 Roller ..... A47B 61/003 211/85.3
2,114,424 A * 4/1938 Jesse ..... A47F 7/19 211/85.3
D131,907 S * 4/1942 Sarvis ..... D6/681
2,292,270 A * 8/1942 Hara ..... A47G 25/54 211/119
2,293,625 A * 8/1942 Huntington ..... A47G 25/54 206/285
D142,059 S * 8/1945 Botsford ..... D6/681.1
2,534,380 A * 12/1950 Schwartzman ..... A47G 25/54 312/3

(Continued)

*Primary Examiner* — Jonathan Liu
*Assistant Examiner* — Devin K Barnett
(74) *Attorney, Agent, or Firm* — Stites & Harbison PLLC; Richard S. Myers, Jr.

(57) ABSTRACT

A wardrobe that has a frame assembly with at least one storage unit attached thereto; with the frame assembly including a base with a U-shaped front base and a U-shaped rear base; at least one base support member joining the front base and the rear base; a left upper frame that is inverted U-shaped and receives the front and rear bases; a right upper frame that is inverted U-shaped and receives the front and rear bases; a left cross support member; a right cross support member; a top support member that joins the left upper frame and the right upper frame; and a storage unit removably attached to a cross support member and a base support member.

14 Claims, 13 Drawing Sheets

(56) References Cited

U.S. PATENT DOCUMENTS 2,643,003 A * 6/1953 Christie ..... A47G 25/74 211/119
2,644,589 A * 7/1953 Levine ..... A47G 25/54 211/118
2,645,541 A * 7/1953 Mintz ..... A47G 25/54 312/6
2,677,584 A * 5/1954 Schulman ..... A47G 25/54 312/5
D179,459 S * 12/1956 Potts ..... D34/20
2,982,422 A * 5/1961 Asproyerakas ..... F16B 12/40 211/134
5,103,985 A * 4/1992 Davis ..... A47F 7/08 211/189
5,190,305 A * 3/1993 Putman ..... B62B 3/10 211/182
5,215,199 A * 6/1993 Bejarano ..... A47B 55/02 211/181.1
5,303,855 A * 4/1994 Veale ..... A47G 25/18 223/85
D357,102 S * 4/1995 Tate ..... D34/17
5,556,118 A * 9/1996 Kern ..... B62B 3/008 280/47.16
6,604,473 B2 * 8/2003 Felsenthal ..... A47B 77/10 108/107
6,644,484 B1 * 11/2003 Sardis ..... A47B 43/00 211/189
6,742,792 B1 * 6/2004 Hooper ..... B62B 3/002 150/154
6,793,223 B2 * 9/2004 Ondrasik ..... B60B 33/0002 280/33.997
D498,618 S * 11/2004 Welch ..... D6/675.1
D546,013 S * 7/2007 Pong ..... D32/58
D587,491 S * 3/2009 Casper ..... D6/678.4
7,909,184 B2 * 3/2011 Clark ..... A47F 7/021 211/87.01
D703,905 S * 4/2014 Tuncel ..... D34/23
D707,978 S * 7/2014 Ruiz ..... D6/514
D728,888 S * 5/2015 Tuncel ..... D34/17
D749,879 S * 2/2016 Wall ..... D6/680.3
D753,940 S * 4/2016 Ruiz ..... D6/681
D755,463 S * 5/2016 Tuncel ..... D34/17
9,804,018 B1 * 10/2017 Muccillo ..... G01G 19/58
D805,710 S * 12/2017 Thuma ..... D34/17
9,840,265 B1 * 12/2017 Thuma ..... B62B 3/186
D827,964 S * 9/2018 Barre ..... D06F 95/004 D32/58
D887,188 S * 6/2020 Felsenthal ..... D6/681.2
2002/0005389 A1 * 1/2002 Guo ..... B65D 85/185 211/85.3
2002/0121493 A1 * 9/2002 Wang ..... A47F 7/19 211/195
2003/0218308 A1 * 11/2003 Lamson ..... B62B 3/02 280/79.3
2004/0056439 A1 * 3/2004 Arceta ..... A47F 5/137 280/47.34
2004/0140282 A1 * 7/2004 Wang ..... A47F 7/14 211/113
2004/0238468 A1 * 12/2004 Dosso ..... A47G 25/1457 211/116
2007/0163974 A1 * 7/2007 Lai ..... A47G 25/0664 211/85.3
2007/0272642 A1 * 11/2007 Baptiste ..... A47B 43/00 211/201
2011/0114581 A1 * 5/2011 Greenspon ..... A47G 25/0685 211/85.3
2012/0074082 A1 * 3/2012 Hornsby ..... A47F 5/10 211/85.3
2012/0097628 A1 * 4/2012 Blacknell ..... A47B 45/00 211/85.3
2015/0321616 A1 * 11/2015 Puett ..... B60R 7/02 224/309
2016/0280243 A1 * 9/2016 Devers ..... B62B 3/005
2018/0317647 A1 * 11/2018 Felsenthal ..... A47G 29/00
2018/0344026 A1 * 12/2018 Felsenthal ..... A47G 25/50

* cited by examiner

WARDROBE WITH STORAGE UNIT

PRIOR APPLICATIONS

This application is a continuation-in-part of U.S. patent application Ser. No. 29/645,693 filed on Apr. 27, 2018, now allowed; the contents of which are incorporated herein by reference.

FIELD OF THE INVENTION

The present invention relates generally to the field of household organization devices.

SUMMARY OF THE INVENTION

Embodiments of the present invention allow a user to organize, and store various items. The present invention allows a user to hang clothing items and also store a variety of items on the same device. The present invention includes detachable storage units that attach to a frame.

In embodiments of the invention, the storage units are releasable attached to a frame assembly. Also, various different sizes, shapes, and types of storage units can be used. Preferably the storage units are interchangeable, so that a user can customize the wardrobe to fit their needs. Also, with many different types of storage units, the user can modify and customize the wardrobe to fit their current or evolving needs.

The wardrobe generally consists of a frame that is rectangular shaped and tall enough to store hanging clothes. It can also include a floor to store various items.

In one embodiment, the present invention is a wardrobe that comprises a frame assembly that has a base and an upper frame. The base comprises a U-shaped front base and a U-shaped rear base and at least one base support member joining the front base and the rear base. The upper frame has a left upper frame and a right upper frame. The left upper frame is inverted U-shaped and receives the front and rear bases. The right upper frame is inverted U-shaped and receives the front and rear bases. In this embodiment, the upper frame also has a left cross support member, a right cross support member, and a top support member that joins the left upper frame and the right upper frame. Removably attached to the frame is a storage unit, typically attached to a cross support member and a base support member.

In another embodiment of the present invention, the U-shaped front base and the U-shaped rear base have two arms and a flattened middle; and left and right inverted U-shaped upper frames have two arms and a flattened middle. The left upper frame has one arm that receives the rear base and one arm that receives the front base, and the right upper frame has one arm that receives the rear base and one arm that receives the front base.

In another embodiment of the present invention, the wardrobe comprises two base support members that connect the front base to the rear base; each joining the arms of a front base to a back base.

In another embodiment of the present invention, the cross support members are parallel with a base support member.

In another embodiment of the present invention, the arms of the upper frames are longer in length than the arms of the bases. This gives the wardrobe a tall, rectangular shape.

In another embodiment of the present invention, the cross support bars connect the arms of the respective upper frames at a point approximately in the middle of the length of the arms.

In one embodiment of the present invention, the bases and the upper frames are tubular. Also, the support members may be tubular.

In other embodiments, the base further comprises a floor. The floor may be attached to a support that joins the arms of the front base and a support that joins the arms of the second base.

In other embodiments, the wardrobe further comprises an upper support connecting the arms of the left upper frame and an upper support connecting the arms of the right upper frame. The upper support can comprise peaks and valleys. This feature allows for it to be used to hang items in place.

The storage units can comprise a panel and a pocket extending the panel, and the panel is attached to the cross support and the base support. Various shapes and styles can be used as the pockets.

The storage units are releasably attached to the wardrobe. In embodiments, the panel comprises a first and a second attachment device arranged so that a portion of the panel wraps around the cross support or the base support and the first attachment device engages the second attachment device. The attachment device can be hook and loop strips.

In embodiments of the present invention, the storage units is removably attached to the left cross support member and a base support member, and a second storage unit is removably attached to the right cross support member and a base support member. They can be the of the same type or different from one another. Multiple styles are interchangeable.

The wardrobe can comprise wheels attached to its base to provide easier mobility.

In yet another embodiment of the present invention, a wardrobe is provided that comprises a frame, a floor, and at least one storage unit attached to the base. The frame comprising a base, a top, and at least one support. The base comprises first and second curvilinear tubes with a ends projecting upward and a flat center portion. The top comprises first and second curvilinear tubes with ends projecting downward and a flat upper portion, with the ends of the first top tube connecting with an end of the first base tube and an end of the second base tube, and the ends of the second top tube connecting with an end of the first base tube and an end of the second base tube. At least one support attaches the first base tube to the second base tube, at least one support attaches to two points on the first top tube, and at least one support attaching to two points on the second top tube. The floor is attached to the base and being parallel with the flat center portion of the base tubes, and the storage unit attached to the frame.

In another embodiment of the present invention, a kit is provided. The kit can comprise two U-shaped base tubes, two U-shaped upper frame members, at least four support tubes, a floor, and a storage unit that has an attachment mechanism to releasably engage at least two of the support tubes. Multiple storage units can be provided. The storage units are the same or different to provide versatility and customability for the user.

Further embodiments of the invention are described herein.

DESCRIPTION OF THE FIGURES

It should be understood that the drawings are provided for the purpose of illustration only and are not intended to be construed as defining the limits of the invention. The foregoing and other objects and advantages of the embodiments described herein will become apparent with reference to the following and detailed description when taken in conjunction with the accompanying drawings.

DESCRIPTION OF THE INVENTION

Figure 1:
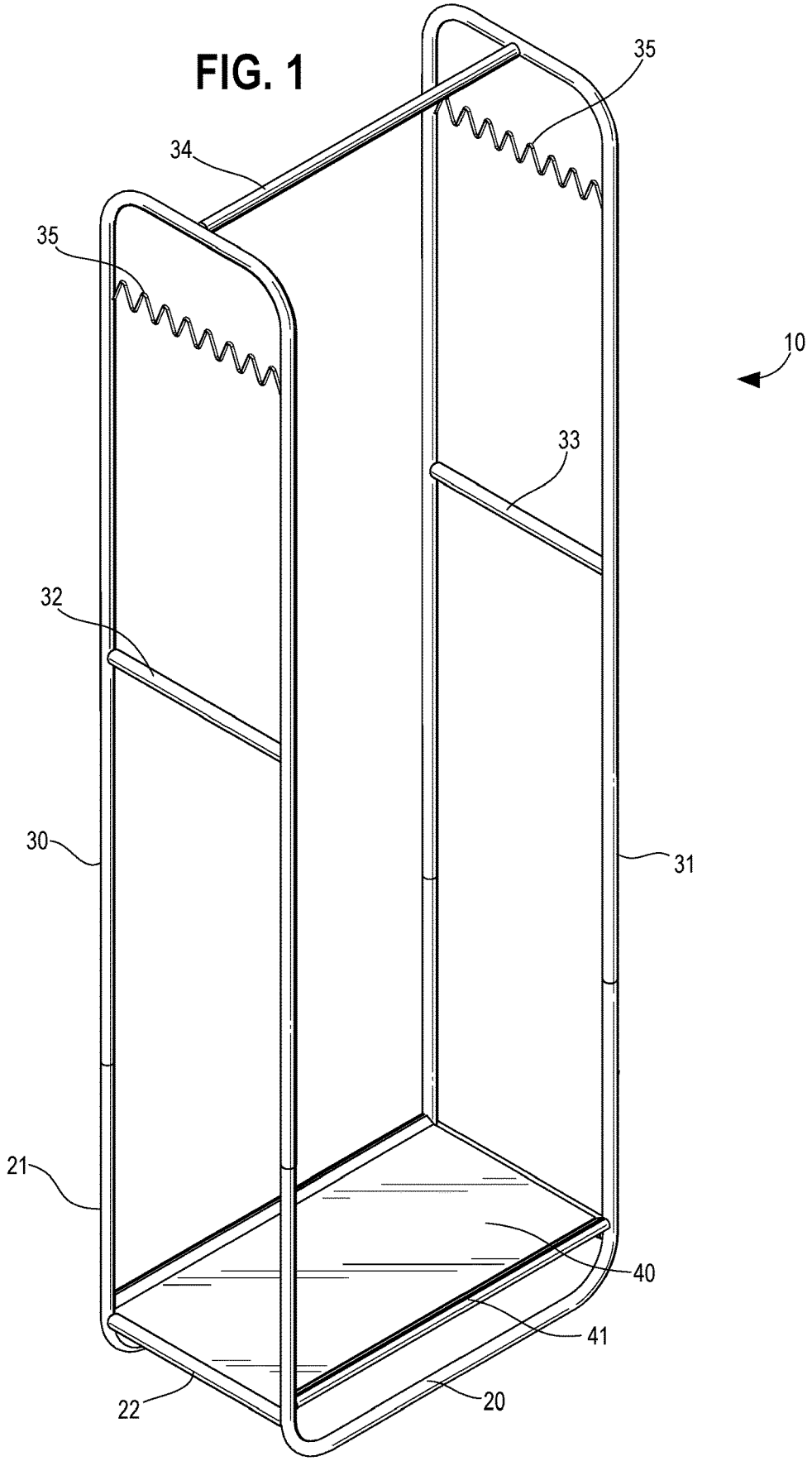
FIG. 1 is a perspective view of an example of a frame assembly of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein. It should be noted that references to "an" or "one" embodiment in this disclosure are not necessarily to the same embodiment, and such references mean at least one.

As stated above, one embodiment of the present invention is a wardrobe that comprises a frame assembly that has a base and an upper frame. The base comprises a U-shaped front base and a U-shaped rear base and at least one base support member joining the front base and the rear base. The upper frame has a left upper frame and a right upper frame. The left upper frame is inverted U-shaped and receives the front and rear bases. The right upper frame is inverted U-shaped and receives the front and rear bases. In this embodiment, the upper frame also has a left cross support member, a right cross support member, and a top support member that joins the left upper frame and the right upper frame. Removably attached to the frame is a storage unit, typically attached to a cross support member and a base support member.

Turning to the drawings, FIG. 1 shows a wardrobe frame assembly 10 of the present invention. It has a base section that comprises a front base 20 and a rear base 21. They are both elongated rods that are U-shaped. Generally, a middle portion of the front base 20 and the rear base 21 is flattened to the extent that the frame assembly can rest upright on this section of the base. The bases comprise at least one support 22 that connect the front base 20 and the rear base 21 and holds them upright.

Attached to the base is a left upper frame 30. The left upper frame 30 can be a U-shaped rod. One of the arms of the left upper frame 30 is attached to the rear base 21 and the other arm is attached to the front base 20. Also attached to the base is a right upper frame. The right upper frame 31 can also be a U-shaped rod. One of the arms of the right upper frame 31 is attached to the rear base 21 and the other arm is attached to the front base 20.

One of ordinary skill in the art would understand that the means of attachment can vary greatly, and is not critical. In one embodiment, the tip of the bases is simply more narrow than the tip of the arms, and the arms of the upper frames rest on top of the arms of the bases. Any number of locking mechanisms can be used, such as pins.

The left upper frame 30 comprises a left cross support 32 that is attached to the arms. The right upper frame 31 comprises a left cross support 33 that is attached to the arms.

The turns in the U-shape of the base and upper frame can be rounded or flattened. For example, it can be up to a 90° bend. Also, the flattened middle on the U-shape can vary in length. The U-shape on the base can have a different angle on the base than it does on the upper frame.

At the top of the frame assembly is a top support 34, which connects the left upper frame 30 with the right upper frame 31. It also serves the purpose of providing a hanger for garments and other items a user chooses to store on the wardrobe assembly.

The bases, upper frames, and supports can be a variety of sizes, thicknesses, and shapes. In the embodiments shown in the drawings, they are tubular for ease of assembly. Also, they can be made from a variety of materials. For example, they may be polymeric, wooden, or metallic. Preferably, the pieces are tubular and metallic.

The base can optionally include a floor 40, which provides another storage option for the wardrobe assembly. The floor 40 can rest on the base support 22, or optionally have its own floor support 41 that is connect to the front and rear bases. Shown in the figures is a solid floor 40. Of course, the surface of the floor can vary. In one example, it can be a mesh floor. The material of the floor is not critical as well. One of ordinary skill in the art could choose from a variety of materials, thicknesses, surface types, etc.

Figure 2:
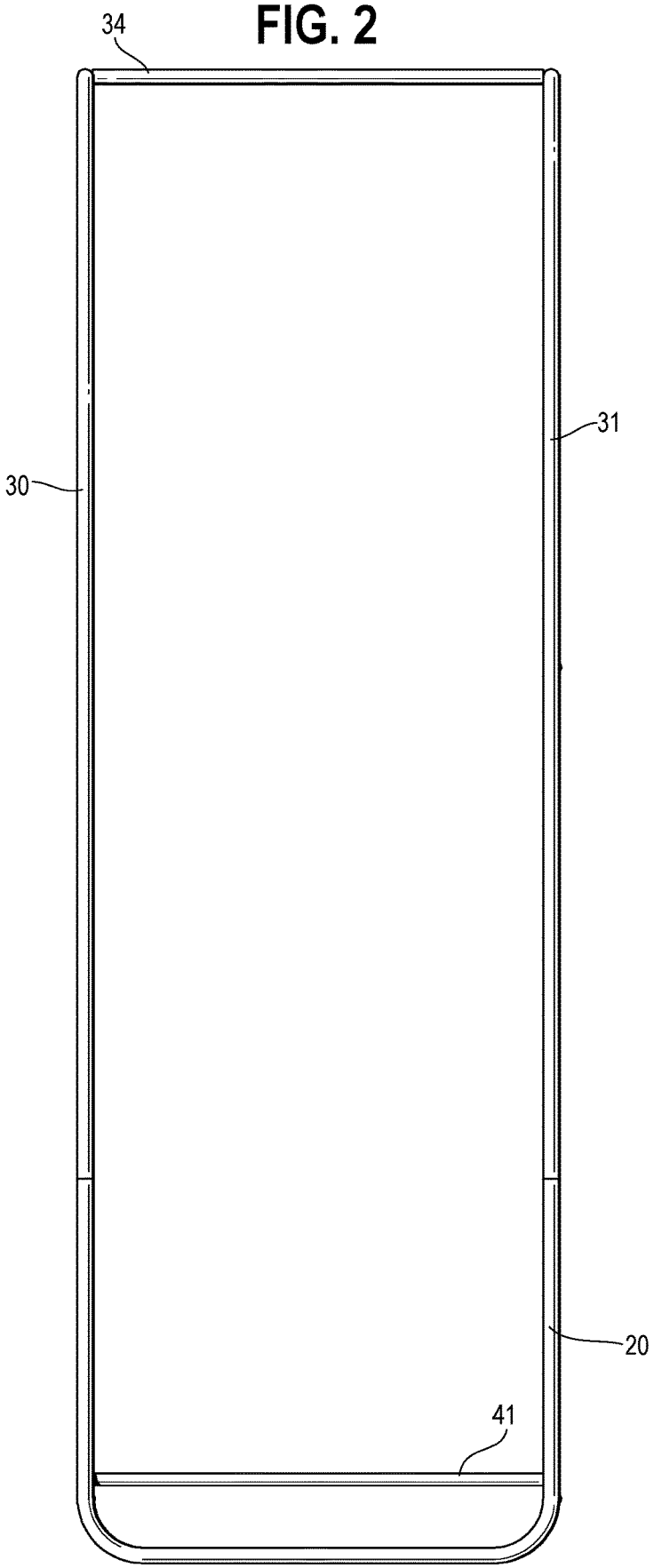
FIG. 2 is a front view of an example of a frame assembly of the present invention.

FIG. 2 shows a front view of a frame assembly of the present invention. This figure shows the left upper frame 30 and the right upper frame 31. Since it is a front view, only the front base 20 can be seen. The floor support 41 is shown. The position of the floor supports with respect to their height along the base can vary.

With the tubular construction of the present invention, the assembly is not limited to a base and upper frame. Between the base and the upper frame can be a at least one additional section of tubing. This would allow for shorter pieces to be used, which is advantageous for packaging and shipping purposes.

Figure 3:
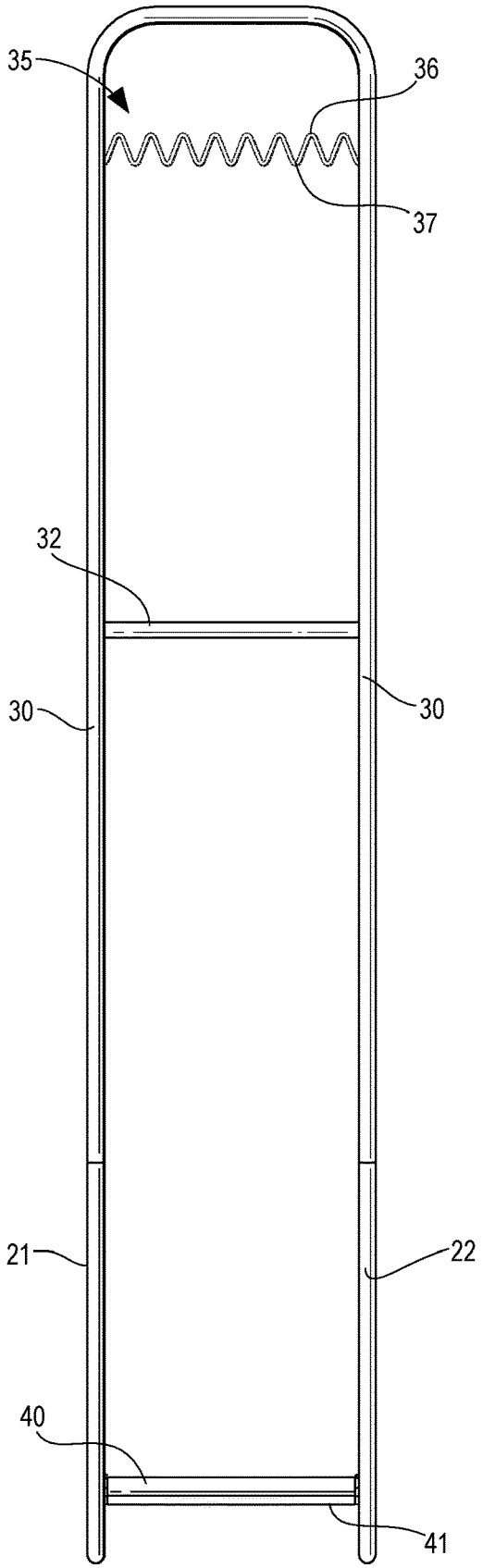
FIG. 3 is a side view of an example of a frame assembly of the present invention.

FIG. 3 shows a side view of a frame assembly of the present invention. With this view, the left upper frame 30 is shown. The arms of the frame are joined and supported by the left cross support member 32. The upper frame 30 is resting on the arms of the rear base 21 and the front base 20. The floor 40 is shown as is the base support member 22. Here, the floor 40 is shown in a position above the base support 22. This arrangement is not critical. Both of these elements can be in multiple positions along the arms of the base.

FIG. 3 also shows the upper support 35, another optional feature of the present invention. Here, an upper support 35 is shown. This supports joins the left upper frame 30 and the right upper frame 31. It can also serve as a means for a user to hang articles. This figure also shows another embodiment of the invention. The upper support 35 is a bar that comprises peaks 36 and valleys 37. A function that they serve is to better hold items that are placed on the upper support 35 in place.

Figure 4:
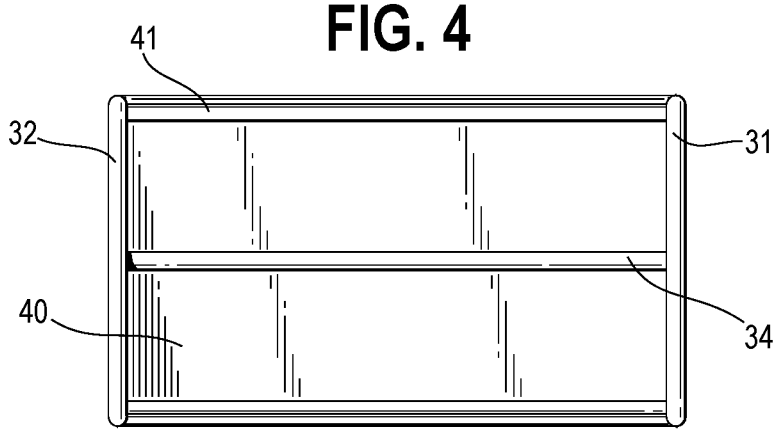
FIG. 4 is a top view of an example of a frame assembly of the present invention.

FIG. 4 is a top view of a wardrobe of the present invention. This figure shows the top support 34, which joins the left cross support member 32 and the right cross support member 31. The floor 40 and the floor support 41 are also shown.

Figure 5:
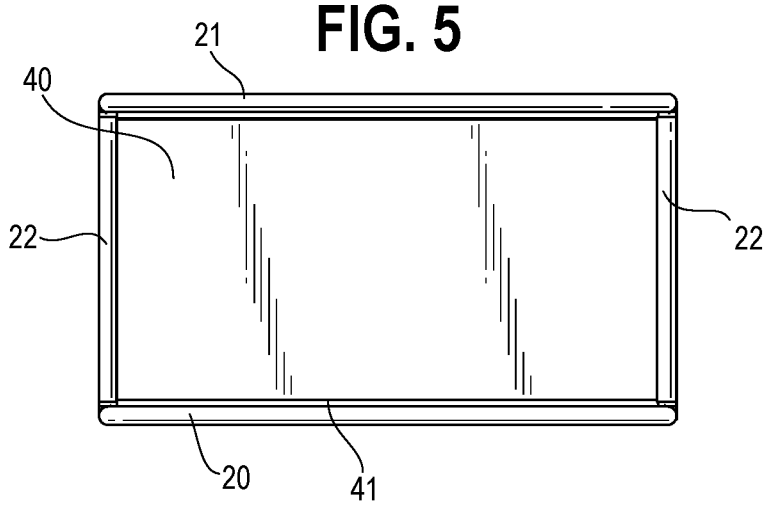
FIG. 5 is a bottom view of an example of a frame assembly of the present invention.

FIG. 5 is a bottom view of a wardrobe of the present invention. With this view, the floor 40 and the floor support 41 are shown. The flattened portion of the U-shaped front base 20 and rear base 21 are shown. Base support members 22 join the front base support 20 and the rear support 21.

Figure 6:
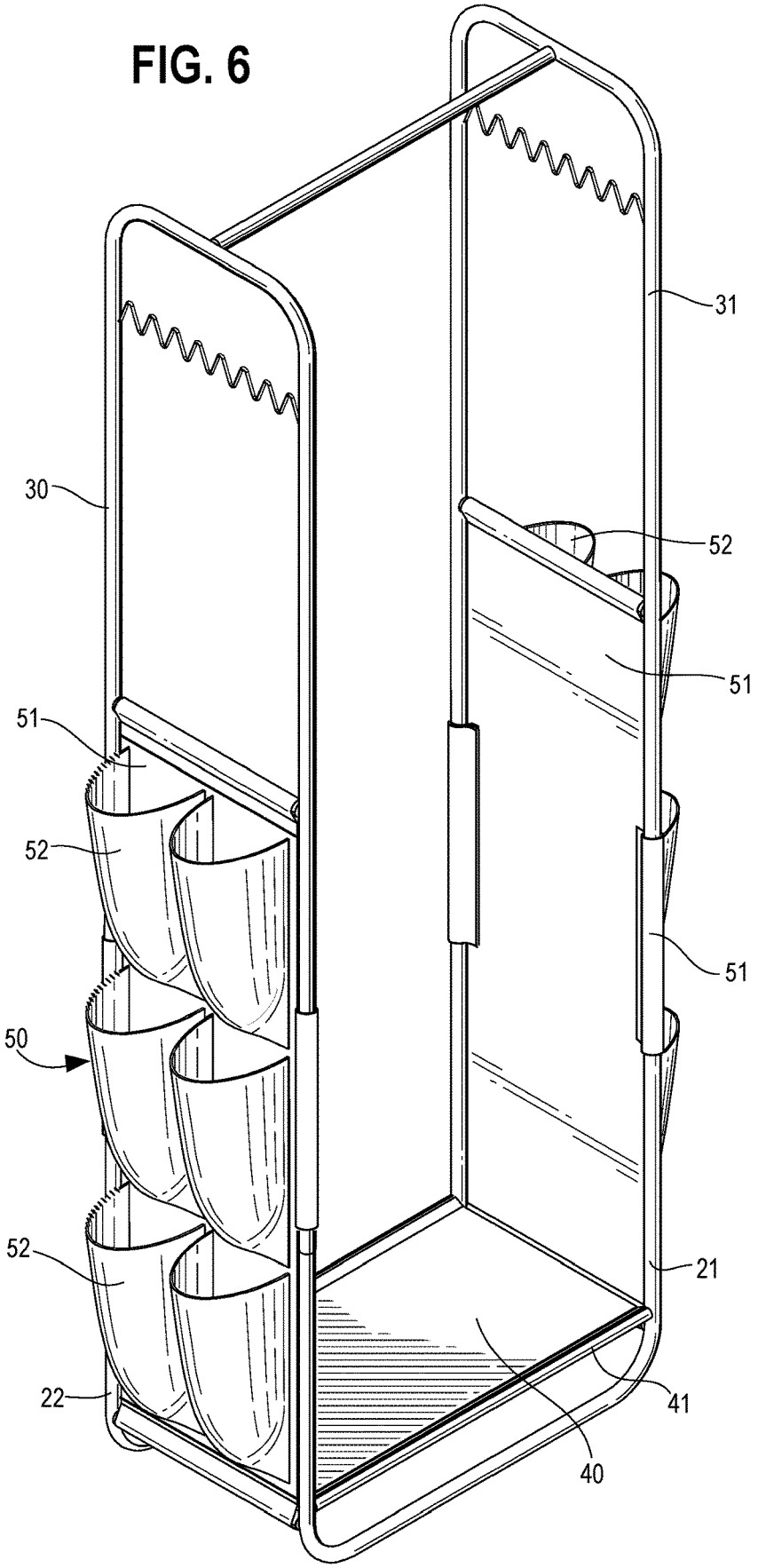
FIG. 6 is a perspective view of an example of a frame assembly of the present invention with an example of a storage unit attached thereto.

FIG. 6 shows a storage unit 50 attached to the frame assembly. In this example, the storage unit 50 comprises a panel 51 that releasably attached to the cross support and the base support. In this example, the panel 51 also attaches to the upper frame. Attached to the panel is a series of pockets 52. Here six pockets 52 are shown. The pockets can be varied greatly in size, shape, style, and number.

Also in this example, there is a storage unit 50 attached to both the left side and the right side of the frame assembly. As is shown herein, the storage units 50 are interchangeable to fit the personalized needs of the user.

Figure 7:
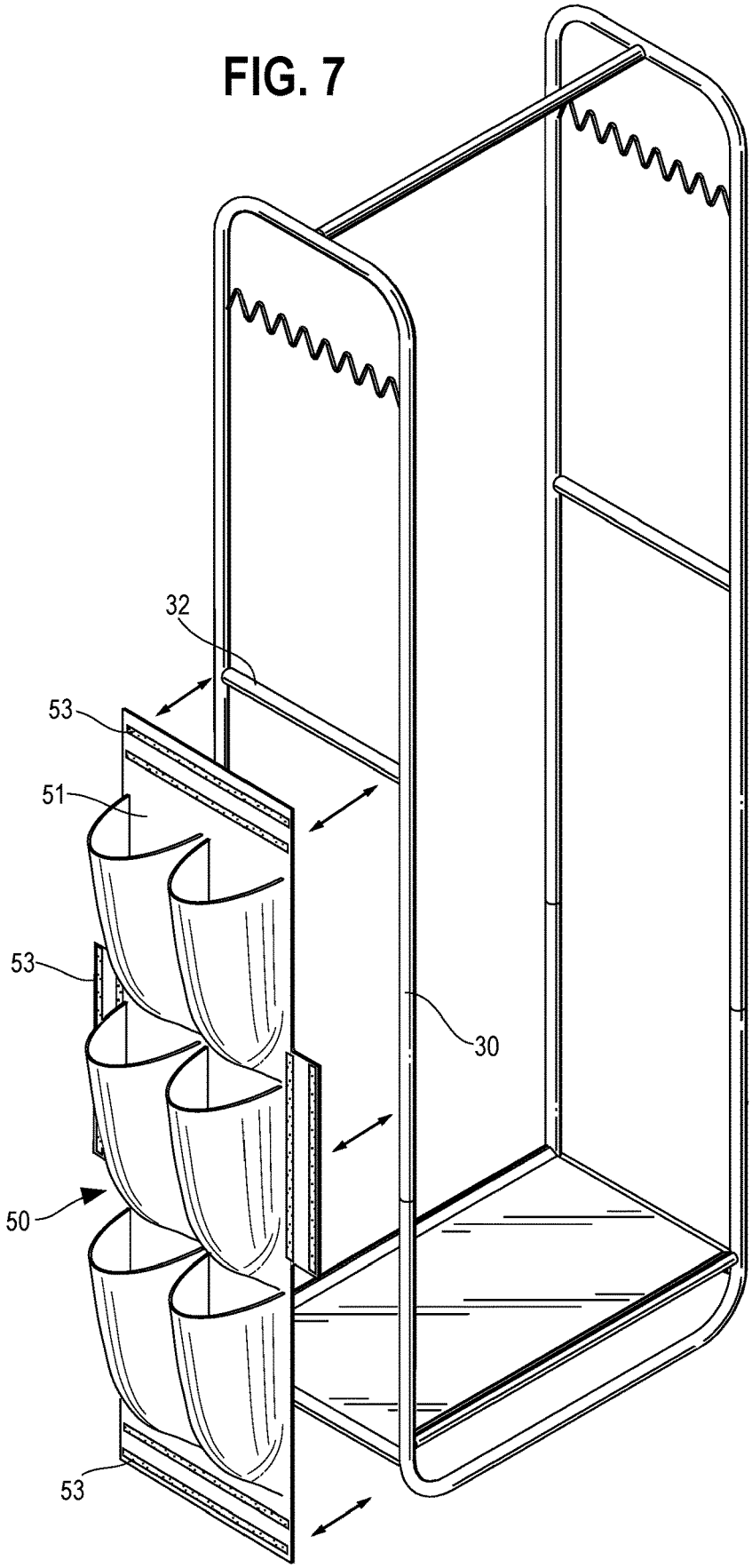
FIG. 7 is a perspective view of an example of a frame assembly of the present invention with an example of how a storage unit can be attached thereto.

FIG. 7 shows an example of how the storage unit 50 can be attached to the frame assembly. Here, the panel 51 comprises attachment strips 53 that wrap around the cross support 32, for example, and attach to one another. A hook and loop-type attachment mechanism is shown in the drawing, but the types of attachment devices can greatly vary. For example, a snap can be used. A feature of the present invention is that the storage unit's attachment to the frame assembly is not permanent. On the other hand, it is releasably attached. This allows a user to mix and match different combinations to customize their storage needs.

Figure 8:
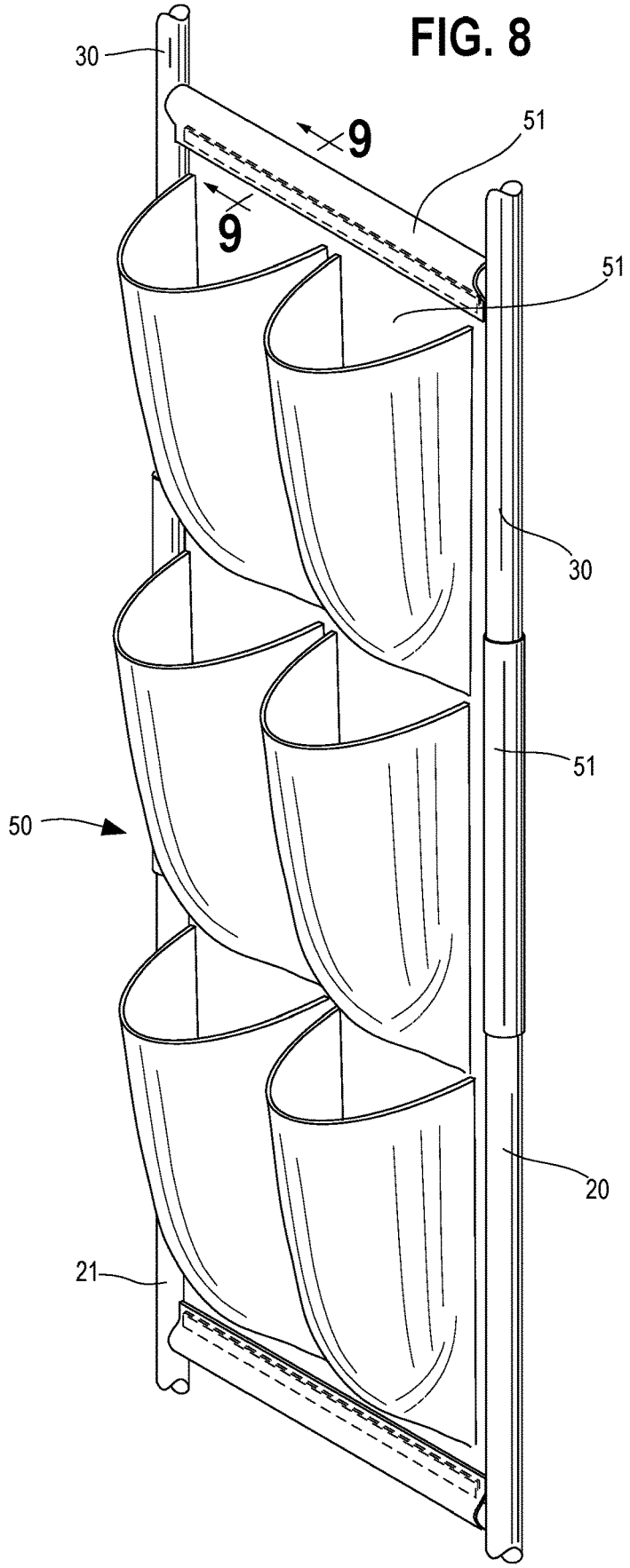
FIG. 8 is a perspective view of a storage unit of the present invention attached to the frame and support bars of a frame assembly of the present invention.

FIG. 8 is a closer view of the storage unit 50 attached to the frame assembly 10. Like the previous example, the storage unit has a panel 51 that attaches to the cross support 32 and the base support 22. The supports are not shown in this figure because they are covered by the panel 51. Here, the panel simply wraps around the respective support and attaches to itself by some type of attachment mechanism. In this example, the panel 51 also attaches to the upper frame 30, but in many cases this extra attachment point will not be necessary.

Figure 9:
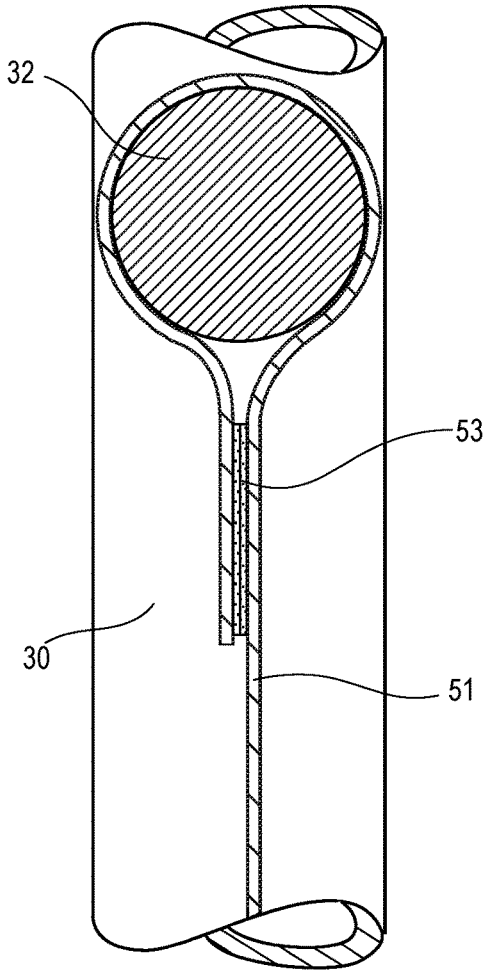
FIGS. 9 and 10 are close-up views of examples of how a storage unit can be attached to a support member of a frame assembly of the present invention.
Figure 10:
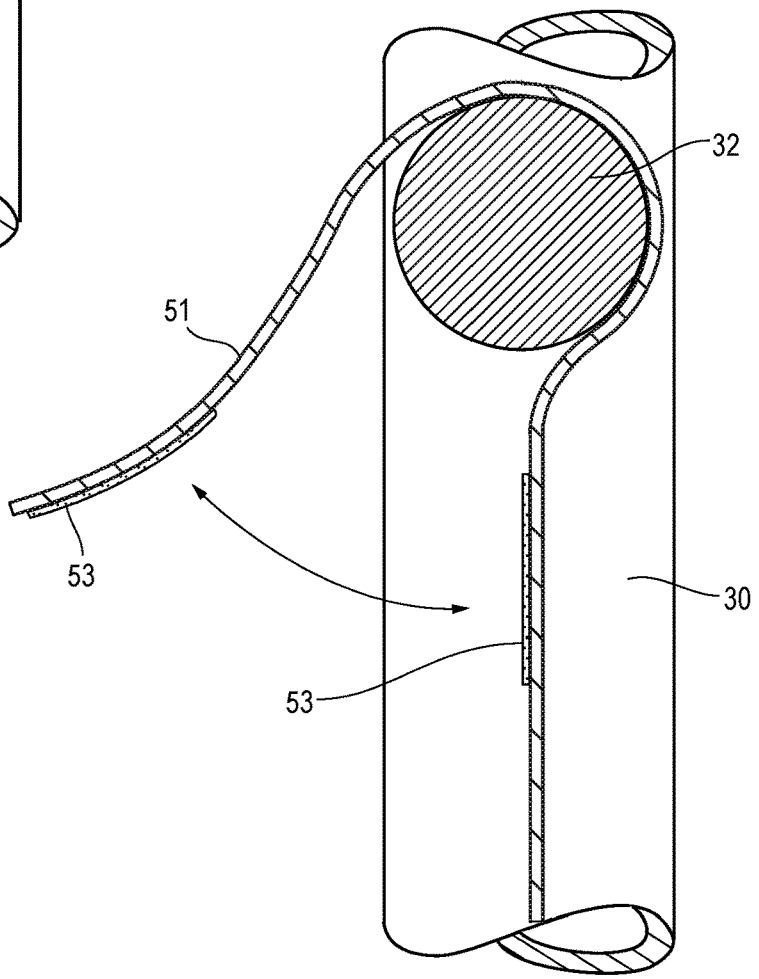

FIGS. 9 and 10 show an example of how the panel 51 can be attached to the supports. In FIG. 9, the panel 51 is wrapped around the cross support 32, and held at an attachment point 53. FIG. 10 shows how the storage unit can be attached or unattached. Once the panel 51 is wrapped around the support, it is attached to itself at the attachment point 53. As an example, this figure shows that attachment mechanism can be hook and loop strips.

Figure 11:
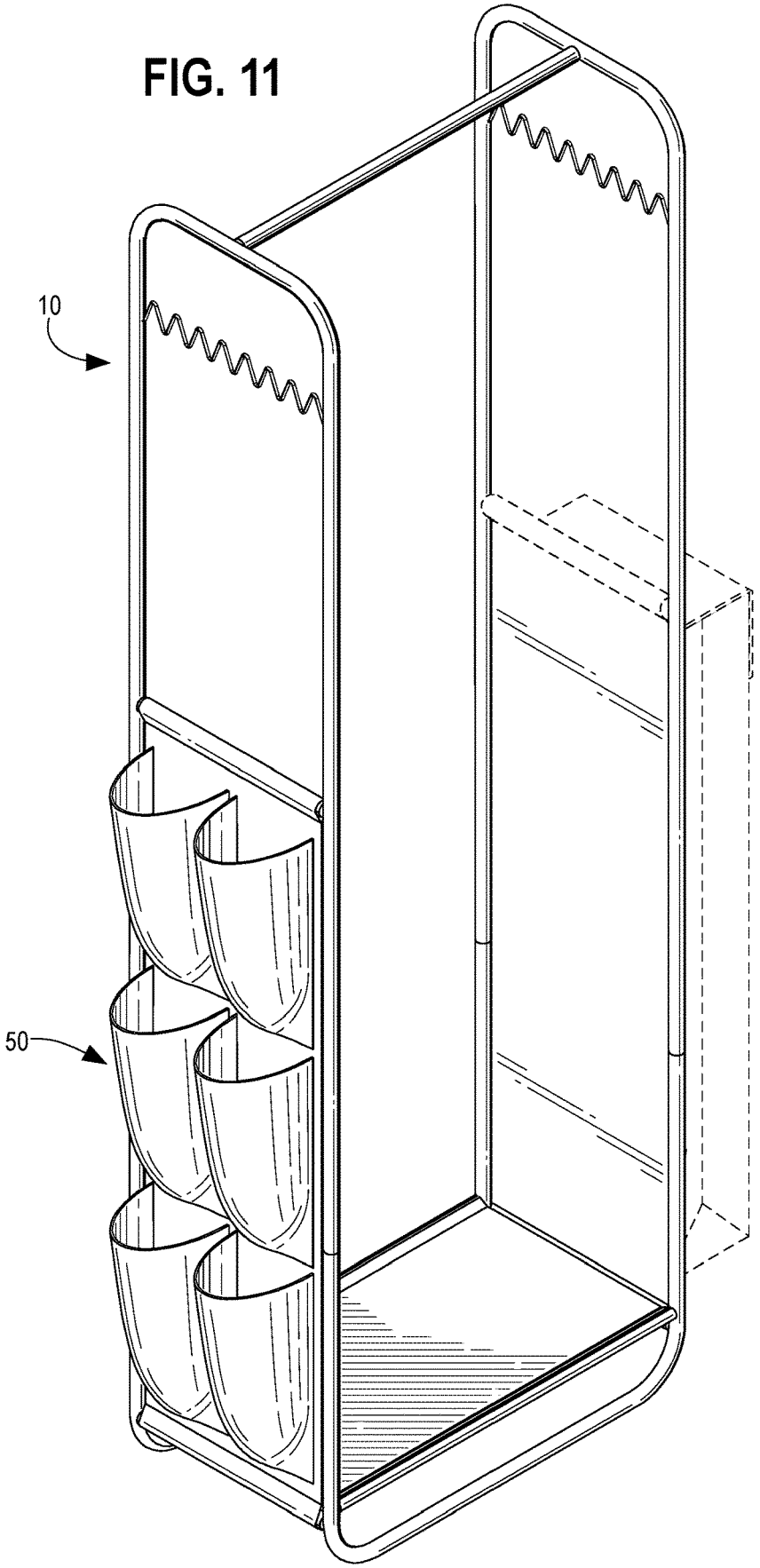
FIG. 11 is a perspective view of an example of a frame assembly of the present invention with a storage unit attached thereto, and an example of a different type of storage unit attached to the other side of the frame assembly.

FIG. 11 is similar to FIG. 6 in that it shows the frame assembly 10 with a storage unit 50 attached thereto. In the figure, the dashed lines represent an optional second storage unit that can be attached to the other upper frame.

Figure 12:
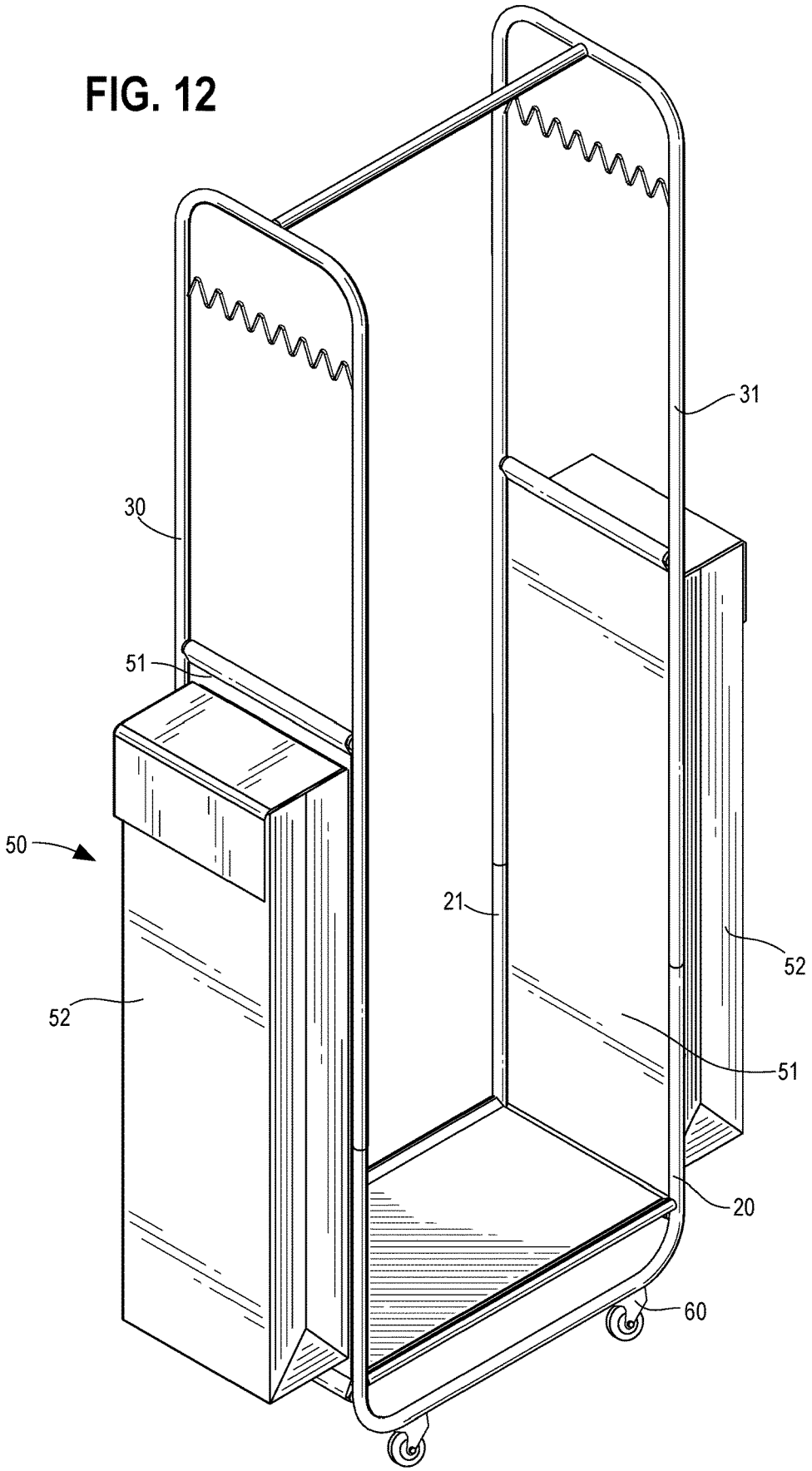
FIG. 12 is a perspective view of an example of a frame assembly of the present invention with two storage units attached to its frame.

FIG. 12 shows an embodiment of the present invention with a different type of storage unit 50 attached to the frame assembly. This storage unit also has a panel 51 which attached to frame assembly supports. This particular example has one pocket 52 extending from the panel 51, and is box-shaped.

This figure also show a feature whereby the wardrobe is resting on wheels 60, for increased mobility.

Figure 13:
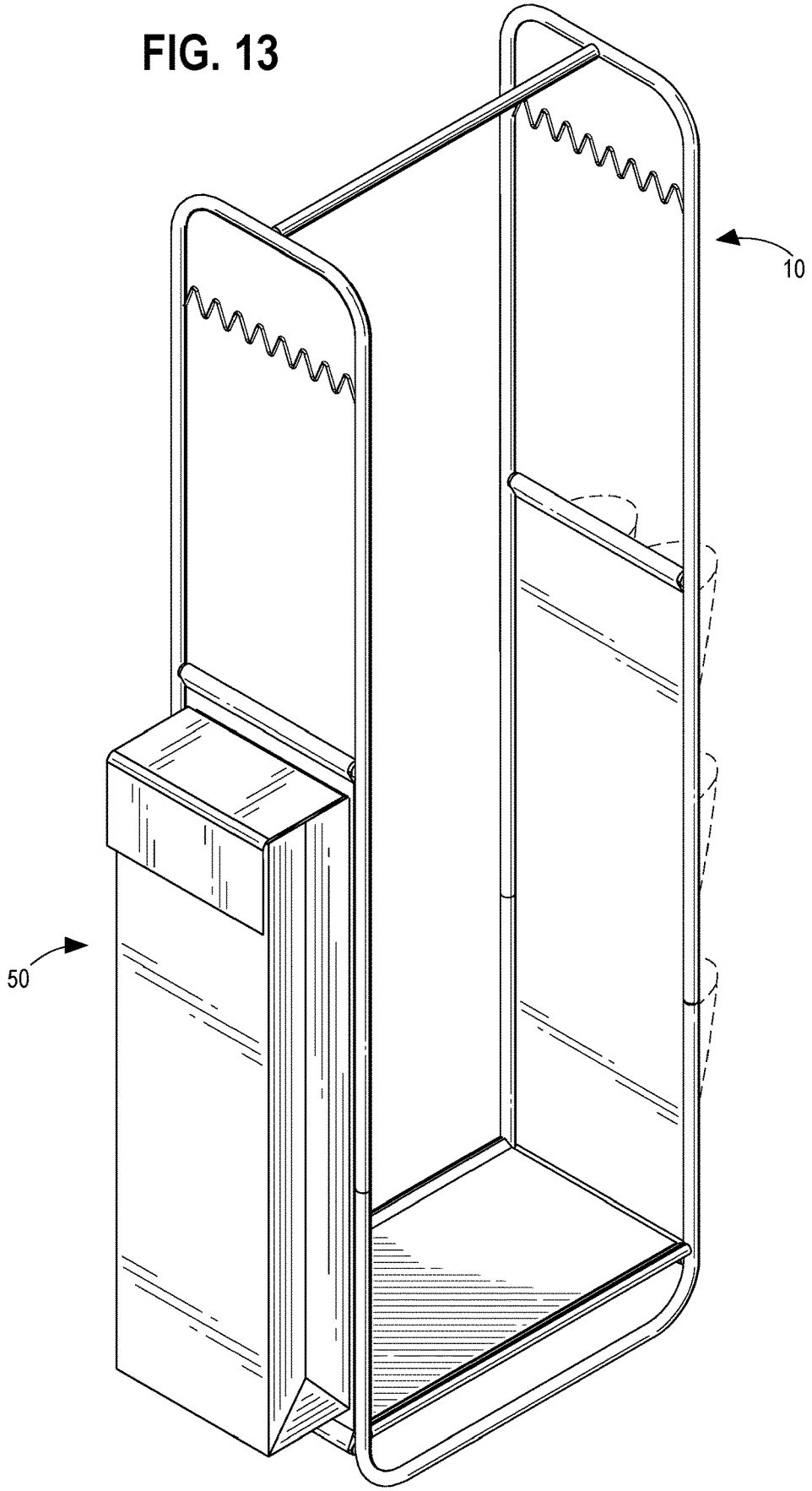
FIG. 13 is a perspective view of an example of a frame assembly of the present invention with a storage unit attached thereto, and an optional storage unit attached to the other side of the frame.

FIG. 13 is similar to FIG. 12 in that it shows the frame assembly 10 with a storage unit 50 attached thereto. In the figure, the dashed lines represent an optional second storage unit that can be attached to the other upper frame. The additional storage unit can be the same or different than the one shown.

Figure 14:
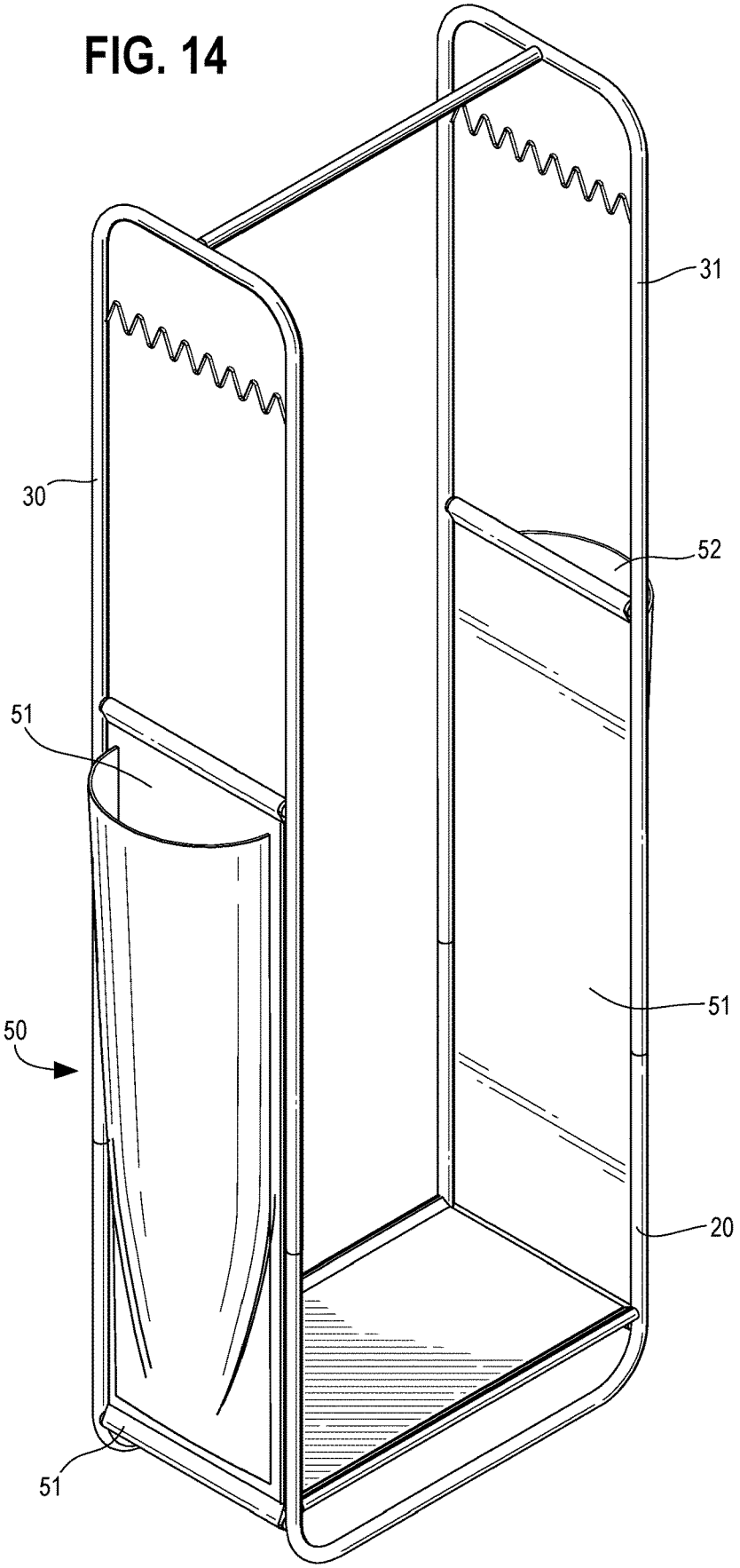
FIG. 14 is a perspective view of an example of a frame assembly of the present invention with two storage compartments attached thereto.

FIG. 14 shows an embodiment of the present invention with a different type of storage unit 50 attached to the frame assembly. This storage unit also has a panel 51 which attached to frame assembly supports. This particular example has one pocket 52 extending from the panel 51, and is sack-like.

Figure 15:
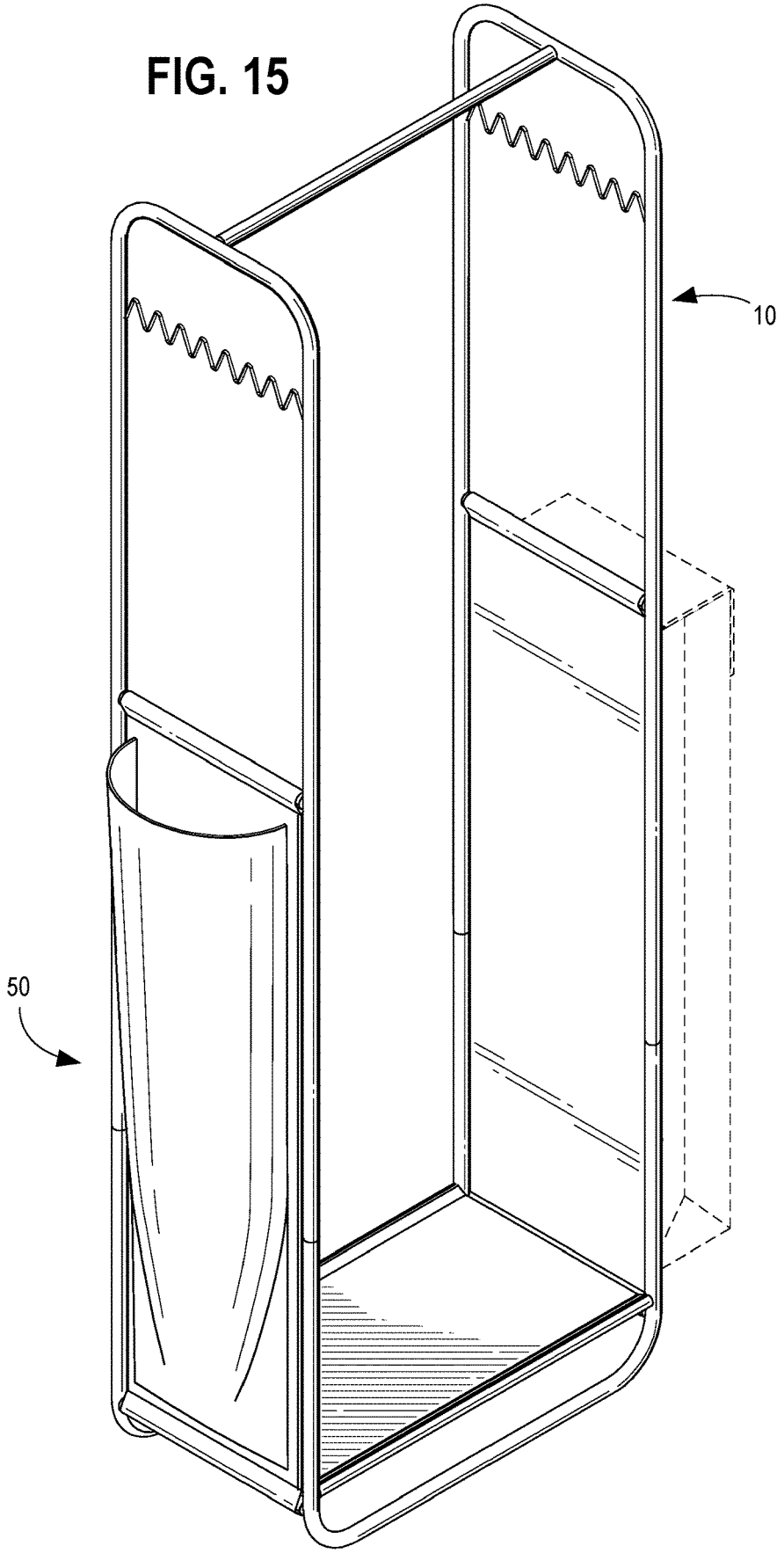
FIG. 15 is a perspective view of an example of a frame assembly of the present invention with a storage unit attached thereto, and an optional storage unit attached to the other side of the frame.

FIG. 15 is similar to FIG. 14 in that it shows the frame assembly 10 with a storage unit 50 attached thereto. In the figure, the dashed lines represent an optional second storage unit that can be attached to the other upper frame. The additional storage unit can be the same or different than the one shown.

As stated above, the present invention can be in the form of an assembled embodiment, or it can be in the form of a kit. The kit of the present invention is advantageous for manufacturing, packaging, and shipping purposes.

The invention thus being described, it will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A wardrobe storage apparatus, comprising:

a frame assembly comprising a base assembly that comprises a U-shaped front base and a U-shaped rear base, wherein the U-shaped front base and the U-shaped rear base each have a flattened middle section and two arms generally perpendicular to the flattened middle section;

at least one base support member joining the front base and the rear base;

an inverted U-shaped left upper frame and an inverted U-shaped right upper frame;

wherein the inverted left upper frame and the inverted right upper frame each have a flattened midsection and two arms generally perpendicular to the flattened midsection;

wherein a first respective arm of the left upper frame receives a first respective arm of the rear base and a second respective arm of the left upper frame receives a first respective arm of the front base, and a first respective arm of the right upper frame receives a second respective arm of the rear base and a second respective arm of the right upper frame receives a second respective arm of the front base;

a left cross support member that extends between and joins the two arms of the left upper frame;

a right cross support member that extends between and joins the two arms of the right upper frame;

a top support member that extends between and joins the left upper frame and the right upper frame; and at least one storage unit that spans between and is removably attached to a respective base support member and at least one of the left cross support member and the right cross support member;

wherein the at least one storage unit comprises a panel defining a length and at least one pocket extending away from the panel and defining a cavity therein, wherein a bottom portion of the respective panel of the at least one storage unit wraps around the respective base support member to removably attach the respective panel to the respective base support member and a top portion of the respective panel wraps around the at least one of the left cross support member and the right cross support member to removably attach the respective panel to the at least one of the left cross support member and the right cross support member.

2. The wardrobe storage apparatus of claim 1, wherein the at least one base support member comprises two base support members that join the arms of the front base to the arms of the rear base.

3. The wardrobe storage apparatus of claim 2, wherein the left cross support member is parallel with a first respective base support member and the right cross support member is parallel with a second respective base support member.

4. The wardrobe storage apparatus of claim 1, wherein the arms of the upper frames are longer in length than the arms of the bases.

5. The wardrobe storage apparatus of claim 1, wherein the bases and the upper frames are tubular.

6. The wardrobe storage apparatus of claim 5, wherein the at least one base support member, the left cross support member, and the right cross support member are tubular.

7. The wardrobe storage apparatus of claim 1, wherein the base assembly further comprises a floor.

8. The wardrobe storage apparatus of claim 1, wherein the base assembly further comprises a floor that is attached to a first support that joins the arms of the front base and a second support that joins the arms of the rear base.

9. The wardrobe storage apparatus of claim 1, further comprising a first upper support connecting the arms of the left upper frame and a second upper support connecting the arms of the right upper frame.

10. The wardrobe storage apparatus of claim 1, wherein the first upper support and the second upper support each comprise peaks and valleys.

11. The wardrobe storage apparatus of claim 1, wherein the respective panel comprises a first attachment device and a second attachment device and the first attachment device engages the second attachment device to secure panel in place.

12. The wardrobe storage apparatus of claim 11, wherein the respective panel further engages the arms of the left upper frame or the arms of the right upper frame.

13. The wardrobe storage apparatus of claim 1, further comprising wheels attached to the base assembly.

14. The wardrobe of storage apparatus claim 1, wherein the at least one storage unit comprises a first storage unit removably attached to the left cross support member and a first respective base support member, and a second storage unit removably attached to the right cross support member and a second respective base support member.

* * * * *